US005184141A

United States Patent [19]

Connolly et al.

[11] Patent Number: 5,184,141

[45] Date of Patent: Feb. 2, 1993

[54] STRUCTURALLY-EMBEDDED ELECTRONICS ASSEMBLY

[75] Inventors: Jerome J. Connolly; Michael D. Barrick, both of Arlington; William L. D'Agostino, Irving; Gerald F. Thomas, Arlington; Thomas W. Williams, Grand Prairie, all of Tex.

[73] Assignee: Vought Aircraft Company, Dallas, Tex.

[21] Appl. No.: 505,757

[22] Filed: Apr. 5, 1990

[51] Int. Cl.[5] ..... H01Q 1/280; H01Q 1/420; H01Q 13/000

[52] U.S. Cl. ..... 343/705; 343/708; 343/785; 343/872; 244/126

[58] Field of Search ..... 343/705, 711, 872, 873, 343/878, 785, 700 MS File, 713, 708, 786; 244/117 A, 117 R, 119, 121, 126

[56] References Cited

U.S. PATENT DOCUMENTS

| | | | |
|---|---|---|---|
| 3,389,394 | 6/1968 | Lewis | 343/785 |
| 3,829,862 | 8/1974 | Young | 343/767 |
| 4,489,328 | 12/1984 | Gears | 343/700 MS File |
| 4,660,048 | 4/1987 | Doyle | 343/700 MS File |
| 4,709,239 | 11/1987 | Herrick | 343/705 |
| 4,749,997 | 6/1988 | Canonico | 343/705 |
| 4,766,444 | 8/1988 | Conroy et al. | 343/700 MS File |
| 4,929,959 | 5/1990 | Sorbello et al. | 343/700 MS File |
| 4,956,393 | 9/1990 | Boyd et al. | 343/873 |

FOREIGN PATENT DOCUMENTS

| | | | |
|---|---|---|---|
| 0359504 | 3/1990 | European Pat. Off. . | |
| 0120302 | 7/1983 | Japan | 343/705 |
| 0114103 | 5/1989 | Japan . | |

OTHER PUBLICATIONS

Cuming, W. R., Radome Sandwich Using Artificial Dielectric Foam, Electronic Design, vol. 6, Apr. 16, 1958, pp. 36–39.

*Primary Examiner*—Rolf Hille
*Assistant Examiner*—Peter Toby Brown
*Attorney, Agent, or Firm*—Richards, Medlock & Andrews

[57] ABSTRACT

A structurally-embedded electronics assembly is disclosed and includes an outer skin member which is lightly loaded structurally, a primary load-carrying member positioned inboard from the outer skin member, a core member positioned between the primary load-carrying member and the outer skin member, an intermediate skin member positioned between the outer skin member and the core member and an electronics structure positioned between a predetermined two of the members or intermingled with a predetermined number of the members set forth above which are adjacent each other. In another embodiment, a thermally conductive baseplate member is positioned inboard from the primary load-carrying member. In another embodiment, a vibration damping member is positioned inboard from the primary load-carrying member.

23 Claims, 3 Drawing Sheets

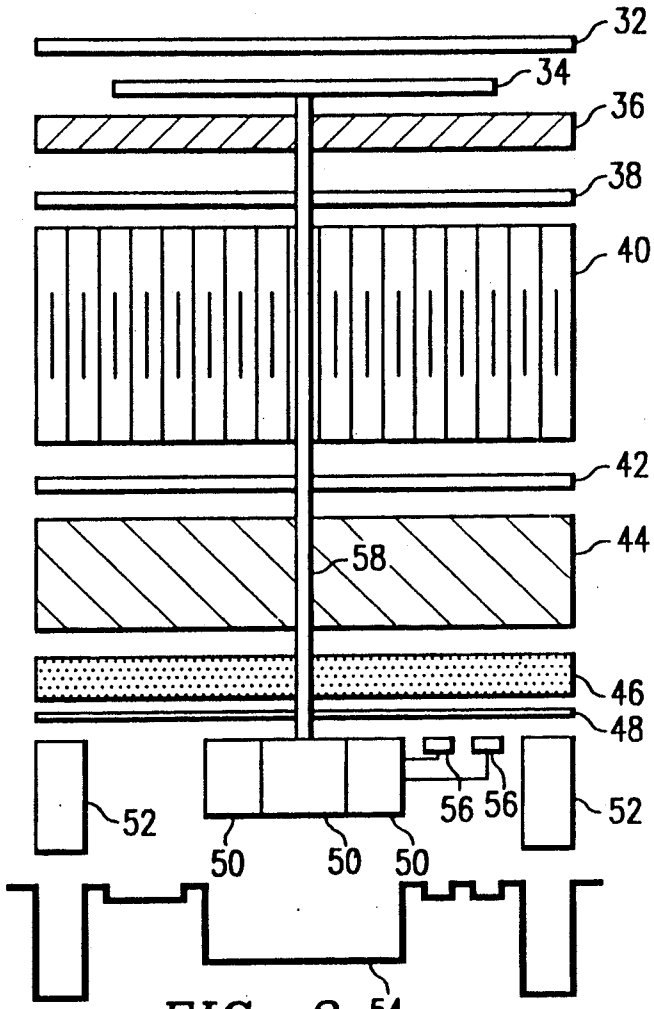
FIG. 2
FIG. 1
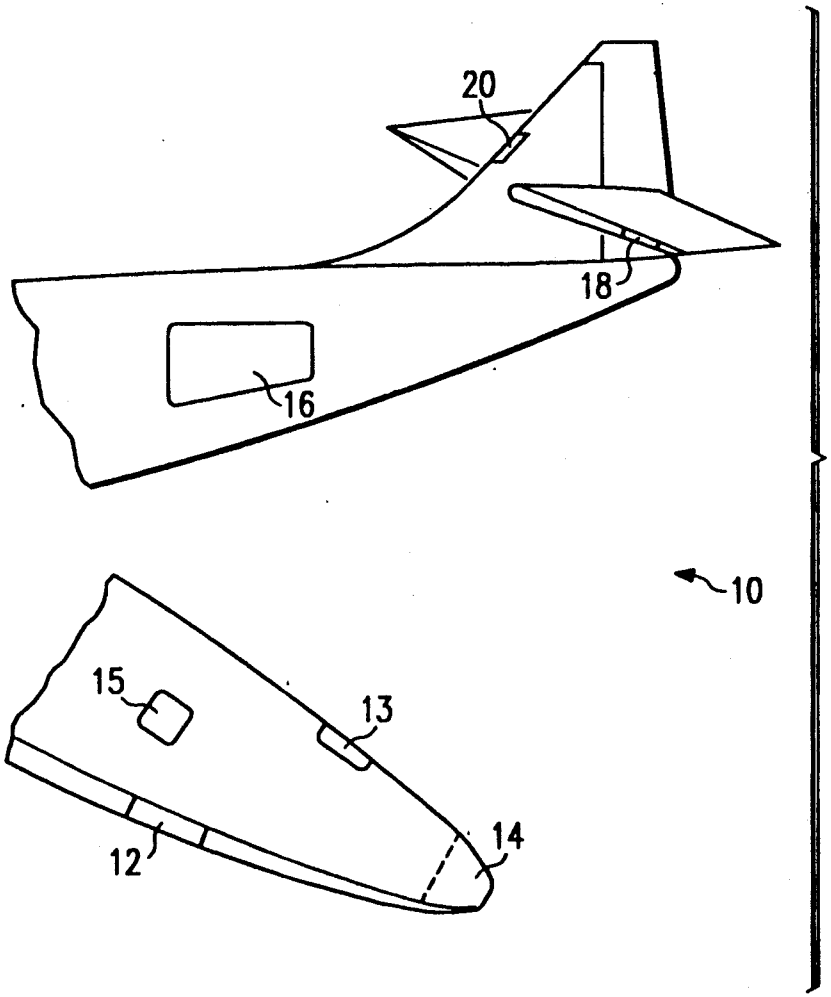

STRUCTURALLY-EMBEDDED ELECTRONICS ASSEMBLY

TECHNICAL FIELD OF THE INVENTION

This invention relates generally to vehicle structure. More particularly, but not by way of limitation, this invention relates to the new and novel integration of antennas and electronics with load-carrying vehicle structure where the term vehicle includes an aircraft, a satellite, an automobile, a boat and the like.

BACKGROUND OF THE INVENTION

Although this invention is applicable to the incorporation of various electronic devices in the structure of a vehicle, it has been found to be particularly useful in the environment of the incorporation of antennas and/or sensors by embedding the antennas and/or sensors in aircraft structure and mounting related electronics/optics, as appropriate, to the backplane. Therefore, without limiting the applicability of the invention to "the incorporation of antennas by embedding the antennas in the aircraft structure", the invention will be described in such environment. The detailed description which follows is for the example of an antenna structure incorporated in an aircraft Typically, today's aircraft antenna systems are not designed to carry structural loads. These structurally parasitic prior art antenna systems adversely affect the overall airframe weight with a corresponding reduction in aircraft performance and fuel consumption. The placement of antennas in aircraft structure is presently limited to locations which are lightly loaded. Basically an opening is cut in the aircraft for mounting an antenna therein. At that location, the load-bearing capability of the structure is reduced. To return the load-bearing capability to the structure, the structure around the opening is normally increased in thickness and overall weight so the load may be carried around the opening. This extra weight, relative to the normal weight of the undamaged or uncut area of the aircraft skin, is undesirable.

It is common practice in the aircraft industry to use a sandwich-type or composite-type structure in the fabrication of aircraft wherein a primary load-bearing skin is provided on the outside, then a core of honeycomb-type or similar material and then a second skin on the inside of the core to provide a stiffer material which is usually stronger and/or stiffer on a weight basis. Although this type of structure provides greater stiffness, the disadvantage with non-metallic designs is that damage to the structure may not be readily apparent and therefore the structure must be over-designed with a damage tolerance criteria. Typically, this type of structure has a large margin of safety included in the design in order to provide for the unknown factor of damage caused by such factors as a worker dropping a wrench on the structure, stones and debris being kicked up from the runway and hitting the structure and the like.

If damage to the outer load-bearing skin of the composite-type structure of the aircraft is visible and is noticed, repair of that damage may require a lengthy and complicated procedure. The damaged structure will normally be moved to a repair facility having the high temperature and high pressure apparatus necessary to make a repair which will ensure that the aircraft has the same structural integrity after the repair as the aircraft had before the damage.

Due to placement limitations imposed by structural load-carrying requirements, antennas and other electronics and avionics are adversely restricted to less than optimum performance. In most cases, antenna o locations are limited to lightly loaded locations where a wingtip location or the leading edge of the horizontal or vertical stabilizer might be a much better location from the standpoint of antenna gain, radio frequency coverage, sensor coverage and the like. When prior art antennas and other electronics and avionics are located at wing-tip or leading edge locations for better overall performance, then the airframe is adversely affected by additional structure and weight.

It is also well known to install an antenna in an aircraft and then surround the antenna with a radome to provide aerodynamic flow around that antenna. The radome is not considered to be part of the primary load path and does not contribute to the load-bearing capability of the aircraft structure. The radome will transfer local airloads to the connecting structure.

The present invention is intended to provide a solution to various prior art deficiencies which include antennas and antenna systems which do not contribute to supporting the structural load in the aircraft.

SUMMARY OF THE INVENTION

This invention provides a structurally-embedded electronics assembly for integration with the load-carrying structure of an aircraft. The inventive assembly solves both the structural and electromagnetic problems associated with incorporating antennas and sensors in an aircraft. In one embodiment, the assembly comprises an outer skin member which is structurally lightly loaded, a primary load-carrying member positioned inboard from the outer skin member, a core member positioned between the primary load-carrying member and the outer skin member, an intermediate skin member positioned between the outer skin member and the core member and an electronics structure positioned between a predetermined two of the members which are adjacent each other or intermingled with a predetermined number of the members set forth above. In another embodiment, a thermally conductive baseplate member is positioned inboard from the primary load-carrying member. In yet another embodiment, a layer of structural adhesive is operatively positioned between the intermediate skin member and the core member. In still another embodiment, a layer of structural adhesive is operatively positioned between the core member and the primary load-carrying member. In another embodiment, a layer of acoustic damping adhesive is operatively positioned between the primary load-carrying member and the thermally conductive baseplate member.

BRIEF DESCRIPTION OF THE DRAWINGS

Other advantages and features of the invention will become more apparent with reference to the following detailed description of a presently preferred embodiment thereof in connection with the accompanying drawings, wherein like reference numerals have been applied to like elements, in which:

FIG. 1 is a simplified pictorial of portions of an aircraft showing only a few of the areas applicable for the present invention;

FIG. 2 is a simplified partial, cross-sectional view of one embodiment of structurally-embedded avionics according to the present invention;

DETAILED DESCRIPTION

Figure 4:
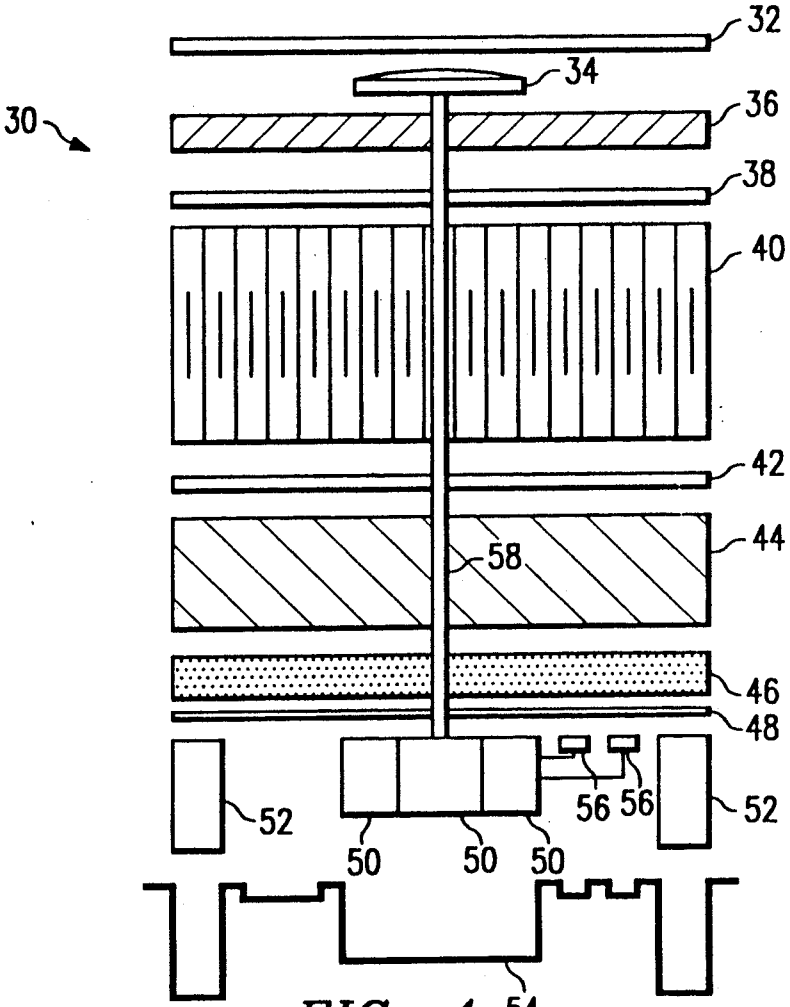
FIG. 4 is a simplified partial, cross-sectional view of an additional embodiment of structurally-embedded avionics according to the present invention.

Referring to the drawing and FIG. 1 in particular, shown therein and generally designated by the reference character 10 is an exemplary aircraft incorporating structurally-embedded electronics structure, in various possible locations in the aircraft 10, that are constructed in accordance with the invention. Various possible locations are the leading edge of a wing 12, the trailing portion of a wing 13, the wing tip 14, the wing surface 15, a fuselage panel 16, the leading edge of the horizontal stabilizer 18 and the leading edge of the vertical stabilizer 20. It will be appreciated that these are only exemplary locations and that there are almost an unlimited number of other locations. It will also be appreciated that structurally-embedded electronics structure includes digital semiconductor devices, microwave semiconductor devices and processors, optical semiconductor devices and processors, antennas, fiber optics, feedhorns, transmission lines, sensors (see FIG. 4) including infra-red devices, optical components and the like. It will be appreciated that the electronics structure may comprise one or more components.

FIG. 2 illustrates one embodiment of the structurally embedded electronics assembly 30 which comprises a lightly-loaded outer skin member or layer 32 which is fabricated from dielectric materials which are "transparent/translucent" to RF (radio frequency) transmission/reception, infra-red or ultra-violet propagation and which provides support to the antenna 34 (electronics structure) and environmental protection to the antenna 34 as well as the inner members or layers. Materials for this outer skin member 32 are selected to match the antenna requirements such as radio frequency, radiated power and other RF requirements as well as environmental resistance. Materials used in this member or layer which are not directly above the antenna 34 will be selected for electrical requirements (such as permeability, permittivity) and selected structural requirements (such as strength-to-weight ratio, stiffness-to-weight ratio, toughness, thermal expansion coefficient and environmental resistance characteristics). Acceptable materials for the outer skin member 32 include, but are not limited to, fiberglass/bismaleimide, fiberglass/epoxy, fiberglass/polyetheretherketone and silicon carbide/-polyimide.

On the inner side of antenna 34 is the intermediate skin member 36 which stabilizes the primary load-bearing inner skin/backplane member 44. Intermediate skin member 36 also provides damage detection/protection for the primary load-bearing inner skin/backplane member 44 as well as providing support and electrical compatibility for antenna 34 with the antenna 34 "sandwiched" or "embedded" between outer skin member 32 and intermediate skin member 36. Embedding antenna 34 does not disturb the exterior surface of the structurally-embedded electronics assembly 30, as opposed to conventional antenna systems which disturb the exterior surface and adversely increase aerodynamic drag. Acceptable materials for intermediate skin member 36 include, but are not limited to, fiberglass epoxy, fiberglass/bismaleimide, silicon carbide/polyimide and others. The lightly-loaded exterior structure comprising outer skin member 32 and intermediate skin member 36 provides a low-energy impact shield which protects the primary load-carrying or load-bearing inner skin/backplane member 44.

Structural adhesive member or layer 38 joins or bonds intermediate skin member 36 to the core member 40. Possible materials for the structural adhesive member or layer 38 include modified epoxy, bismaleimide or polyimide materials.

The core member 40 provides improved structural efficiency to the overall assembly as well as providing for electrical loading of antenna 34. A core is basically apparatus to separate structural layers or members. The core member 40 can be easily modified to match the antenna's electromagnetic requirements by loading the core member 40 with electromagnetic absorbers and/or other materials with selected electromagnetic properties. Acceptable configurations for the core member 40 include, but are not limited to, a reinforced honeycomb, an open cell foam, a semi-rigid foam, a closed-cell foam and the like. Acceptable materials for the core member 40 include, but are not limited to, fiberglass reinforced polyimide, polyvinyl chloride, epoxy, polyvinyl chloride closed cell foam and the like.

Structural adhesive member or layer 42 joins or bonds the inner skin/backplane member 44 to the core member 40. Acceptable materials for the structural adhesive member or layer 42 include, but are not limited to, a modified epoxy or bismaleimide or polyimide.

Structural adhesive members or layers 38 and 42 are used to bond the core member 40 to the rest of the laminated assembly. In some designs, these adhesive layers may be omitted when the choice of resin systems for the laminate provides sufficient bonding.

The inner skin/backplane member 44 is the primary structural load-carrying or load-bearing member of the total assembly and comprises high-strength advanced composite materials. The inner skin/backplane member 44 is protected from low-energy impact damage by the external members or layers above it. With this protection, this inner skin/backplane member 44 is not penalized by restrictive low-energy impact damage design criteria and therefore can be designed to be lighter than traditional composite structures. Likewise, this design protects the primary load carrying composite plies from high transient temperatures. Acceptable materials for the inner skin/backplane member 44 include, but are not limited to, carbon/epoxy, fiberglass/epoxy, carbon/bismaleimide, carbon/polyimide, silicon carbide/epoxy, fiberglass/bismaleimide and the like.

Acoustic damping adhesive member or layer 46 is positioned between the inner skin/backplane member 44 and thermally conductive baseplate member 48 and isolates avionic (electronic and optical) components 50 from high vibration and also reduces vibration fatigue of the entire assembly. Installation of the avionic components 50 in thermal contact with the thermally conductive baseplate member 48, which is positioned on the back side (backplane) of the inner skin/backplane member 44, provides a cooler, lower-vibration environment and shields components from external electromagnetic interference Power leads 56 supply electrical power to the electronic components/modules 50. Specific electronic components 50 include RF transmission lines, optical fibers, dedicated RF processor modules and the like. Acceptable materials for the acoustic damping adhesive member or layer 46 include, but are not limited to, polysulfide adhesive, modified epoxy and the like.

The acoustic damping adhesive member or layer 46 and the thermally conductive baseplate member 48 may not be included in all embodiments of the present invention. In some embodiments, the electronic components/modules 50 are installed a predetermined distance from the inner skin/backplane member 44 and are connected to the assembly by a predetermined length of antenna feed 58.

Cooling systems like cooling pipes 52 conduct heat away from the electronic modules/components 50 directly and via the thermally conductive baseplate member 48. The electronic cooling system may consist of a variety of thermal management/heat transfer methods including thermally-conductive materials, cooling pipes and heat sinks as well as other thermal management systems. Holes may also be provided through core member 40 for cooling purposes. Thermally-conductive materials will reduce thermal loading on the backplane-mounted electronic components. The inner skin/backplane member 44 also provides thermal protection as does the core member 40. A conformal inner coating 54 covering the electronic components 50 provides additional environmental and corrosive protection to the attached electronic components 50. Acceptable materials for the conformal inner coating 54 include, but are not limited to, silicone, epoxy, polyurethane, polyphenylene sulfide and the like.

Antenna feed 58 connects antenna 34 with the electronic components/modules 50. Types of antenna feed 58 include stripline, microstrip, coax, waveguide and the like.

One of the primary advantages of the present invention is that the structural load-carrying member (inner skin/backplane member 44) is internal to (inboard from) the external surface of the structurally-embedded electronics assembly 30 and the external surface of the aircraft and therefore is less susceptible to damage by dropped wrenches, thrown rocks and the like. Yet the overall sandwich-type structure of the invention provides the necessary structural strength and stiffness without an increase in overall weight. Instead of now being limited to locations in the aircraft which are lightly loaded (structurally), the assembly may be located in wingtips, leading edges and the like where the performance of the antenna 34 and/or sensors (electronics structure) will be enhanced by an increased field of view while still maintaining the structural requirements and load carrying capability of the aircraft.

Instead of an opening in the aircraft housing with an antenna which does not contribute to the load-carrying requirements, the structurally-embedded electronic assembly 30 provides load-carrying structure with the primary load-carrying member positioned inboard from the outer surface without an increase in weight over the prior art structure. If weight is not a problem, the assembly may be made heavier.

Ideally, the structurally-embedded electronics assembly 30 would be constructed in the form of a complete panel or unit for the fuselage, wing tip, leading edge, and the like such that the assembly could be attached to the aircraft as a unit. When installing the structurally-embedded electronics assembly 30 on existing aircraft, the primary load path can be translated to the inside load carrying member 44 by various methods including metallic fittings and the like. This will make it easy to install the present invention in existing aircraft. The minimum size of the structurally-embedded electronics assembly 30 is primarily dependent upon the particular type of antenna or sensor and the frequency or band of frequencies employed.

The inventive assembly provides a unit which is easier to repair if damaged by an external force, such as a dropped or thrown object, since the primary load structure is not located on the external surface of the aircraft. The damaged area containing the dent or break could be removed (down as far as the inner skin/backplane member 44) and replaced with a similarly shaped volume or core using adhesives which could be cured in the air-field hanger with readily available equipment. The aircraft or a portion thereof would not be required to be transported back to a major repair facility as Would be necessary with the prior art composite structure without the structurally-embedded electronics assembly 30.

It will be appreciated that many different types of antennas or electronics structure may be incorporated into the structurally-embedded electronics assembly 30. These types of antennas would include printed circuit antennas such as stripline slots, printed circuit dipoles, microstrip patches and the like. Antenna 34 may also comprise an equiangular spiral, a log periodic dipole array, a Yagi-Ude array, and the like.

Figure 6:
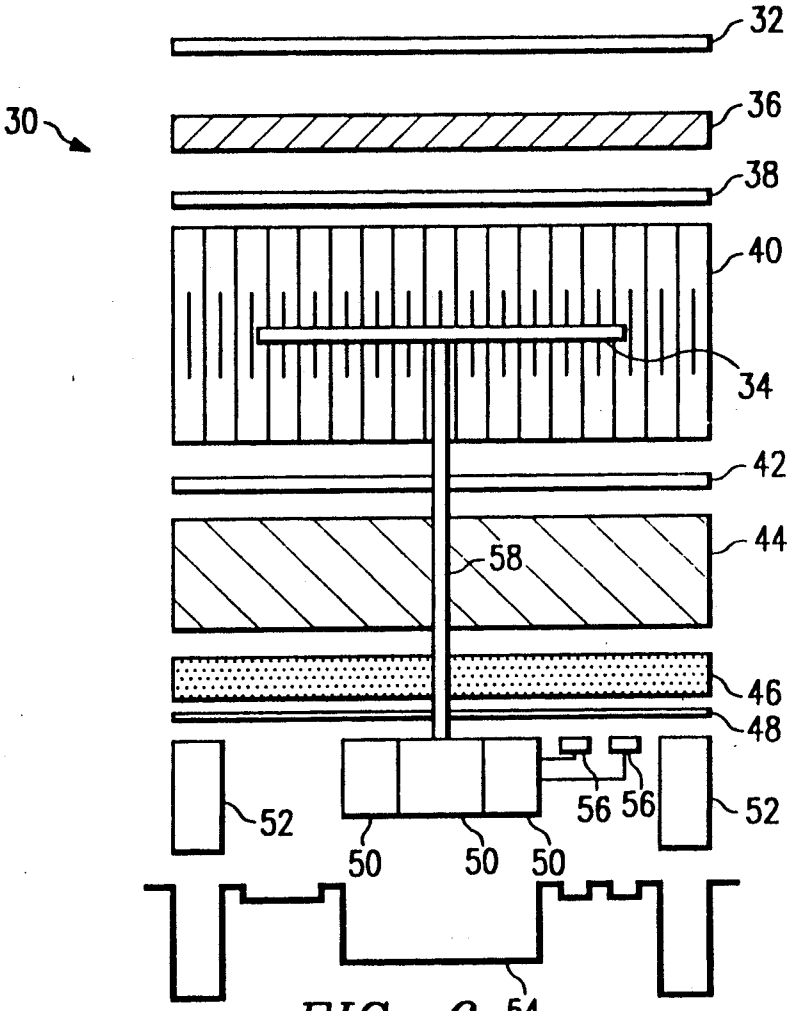
FIG. 6 is a simplified partial, cross-sectional view of still another additional embodiment of structurally-embedded avionics according to the present invention.
Figure 5:
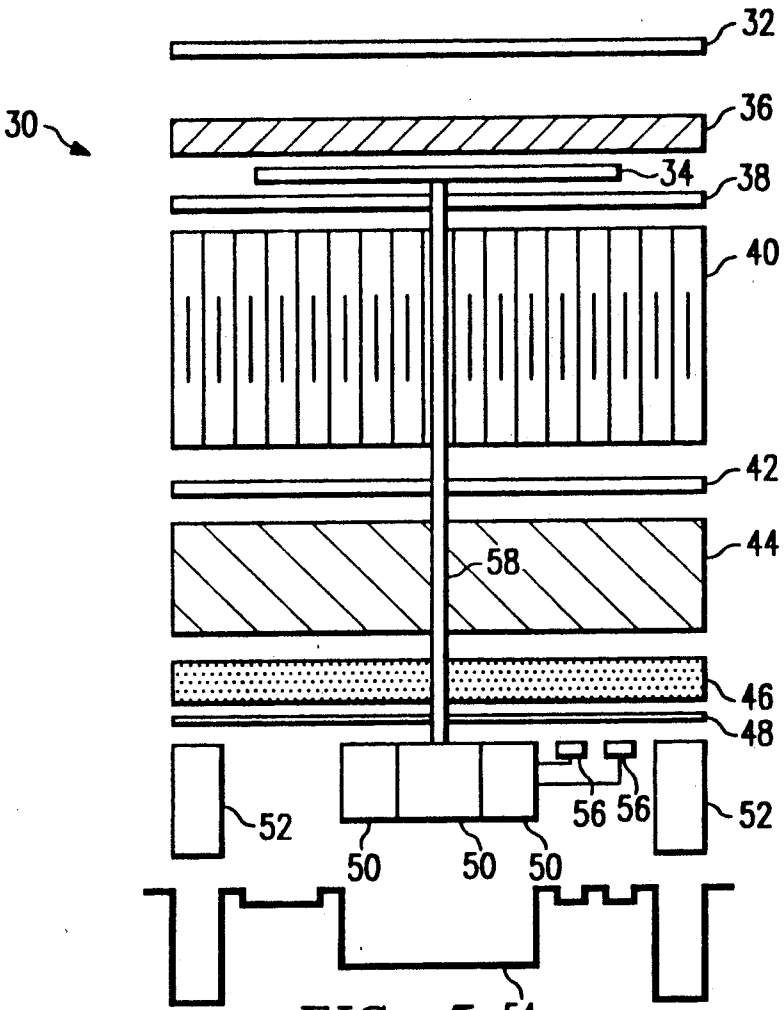
FIG. 5 is a simplified partial, cross-sectional view of another additional embodiment of structurally-embedded avionics according to the present invention.

The location of antennas and/or sensors is not limited to being between outer skin member 32 and intermediate skin member 36. The antenna 34 could be located between any of the two adjacent members disclosed in FIG. 2 or even in the core member 40 (see FIGS. 5 and 6). The operation of the antenna 34 might not be as efficient in some of the locations but the antenna would operate satisfactorily for certain requirements.

The orientation of antenna 34 is not limited to being parallel to the various layered members comprising the structurally-embedded avionics assembly 30. Antenna 34 could be slanted with respect to the orientation of the various layered members and could even cut through one or more of the members.

Various sensors could be positioned at the various antenna locations and at locations throughout the structure to sense strain, temperature, pressure, and the like.

Figure 3:
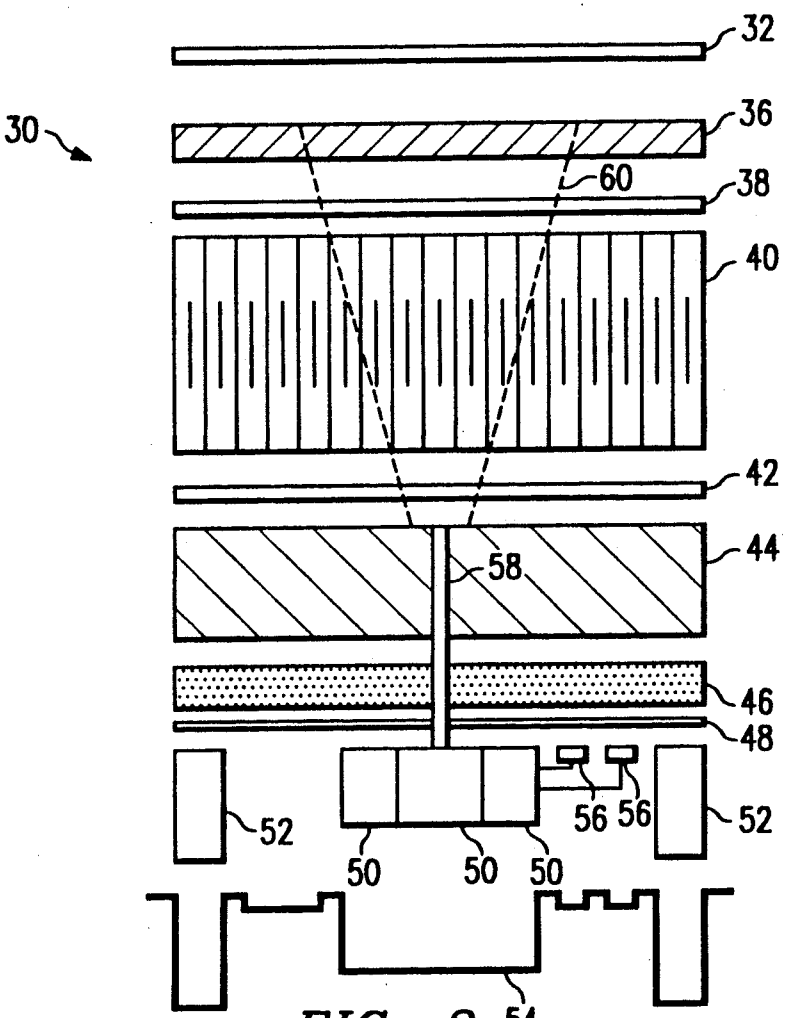
FIG. 3 is a simplified partial, cross-sectional view of another embodiment of structurally-embedded avionics according to the present invention.

It will be appreciated that antenna 34 could be an electromagnetic gain horn 60 as shown in FIG. 3 in which primarily the core member 40 and the intermediate skin member 36 are electromagnetically tailored to confine and direct the energy from antenna feed 58 as though horn 60 was a solid metal structure. By adding a predetermined pattern of carbon particles, metal particles, other low emissivity materials, or other materials with specific electromagnetic properties to selected layered members, the electromagnetic characteristics (permeability, permittivity) of those layered members can be changed. In this way, the electromagnetic energy can be directed along a predetermined path or area. This electromagnetic energy is confined by differences in dielectric constants or by using low emissivity materials at the edges of the horn, and the like.

It is desirable to have an antenna which radiates effectively without impedance mismatches and also receives effectively without impedance mismatches. One desirable method of accomplishing this goal is to control the permeability and permittivity of the materials around the antenna 34 to maximize antenna performance. Carbon, glass, metal particles or the like can be added to any of the layered members to change their electromagnetic properties. One or more conductive or partially conductive planes can be positioned in the core 40 at the correct spacing, in proportion to a wavelength, from antenna 34 to constructively increase the radiated energy from the structurally-embedded electronics assembly 30 in a direction away from the aircraft.

It will be appreciated that the present invention provides an avionics system which includes structural properties and which can be embedded directly in or mounted conformally to an aircraft structure with a reduction in added weight with respect to the prior art installations. Materials which can be introduced into the various members are selected and positioned in the various members to tailor requirements for permeability, permittivity, directivity of energy and the like.

Although the present invention has been described with reference to a presently preferred embodiment, it will be appreciated by those skilled in the art that various modifications, alternatives, variations and the like may be made without departing from the spirit and scope of the invention as defined in the appended claims.

We claim:

1. A structurally-embedded electronics assembly for integration with the load-carrying structure of a vehicle, said structurally-embedded electronics assembly comprising:

an outer skin member;

a primary load-carrying member positioned inboard from said outer skin member, said primary load-carrying member being structured for attachment to the load-carrying structure of the vehicle;

a honeycomb core member positioned between said primary load-carrying member and said outer skin member;

an electronics structure positioned between said outer skin member and said honeycomb core member;

a thermally conductive baseplate member positioned on the side of the primary load-carrying member which is away from said core member; and a layer of acoustic damping adhesive operatively positioned between said primary load-carrying member and said thermally conductive baseplate member.

2. The structurally-embedded electronics assembly of claim 1 further including a layer of structural adhesive operatively positioned between said core member and said primary load-carrying member.

3. The structurally-embedded electronics assembly of claim 1 wherein said electronics structure comprises an antenna.

4. The structurally-embedded electronics assembly of claim 1 wherein said electronics structure comprises a sensor.

5. The structurally-embedded electronics assembly of claim 1 wherein said primary load-carrying member comprises carbon/epoxy.

6. The structurally-embedded electronics assembly of claim 1 wherein said primary load-carrying member comprises fiberglass/bismaleimide.

7. The structurally-embedded electronics assembly of claim 1 wherein said outer skin member comprises fiberglass/bismaleimide.

8. The structurally-embedded electronics assembly of claim 1 wherein said outer skin member comprises fiberglass/epoxy.

9. The structurally-embedded electronics assembly of claim 1 wherein said core member comprises a fiberglass reinforced polyimide core.

10. The structurally-embedded electronics assembly of claim 1 wherein said core member comprises a polyvinyl chloride closed cell foam core.

11. The structurally-embedded electronics assembly of claim 1 further including an intermediate skin member positioned between said electronics structure and said core member.

12. The structurally-embedded electronics assembly of claim 4 further including a layer of structural adhesive operatively positioned between said intermediate skin member and said core member.

13. The structurally-embedded electronics assembly of claim 11 wherein said intermediate skin member comprises fiberglass/bismaleimide.

14. The structurally-embedded electronics assembly of claim 11 wherein said intermediate skin member comprises silicon carbide/polyimide.

15. The structurally-embedded electronics assembly of claim 1 further including electronic modules operatively mounted to said thermally conductive baseplate member on the side thereof away from said primary load-carrying member.

16. The structurally-embedded electronics assembly of claim 15 further including an electromagnetic feed between said electronic modules and said electronics structure.

17. The structurally-embedded electronics assembly of claim 15 further including cooling means operatively positioned with respect to said electronics modules to provide cooling thereto.

18. The structurally-embedded electronics assembly of claim 15 further including a protective conformed coating covering said electronic modules.

19. The structurally-embedded electronics assembly adapted for integration with a structure, comprising:

an outer skin member;

a primary structural member positioned inboard from said outer skin member, said primary structural member being structured for attachment to the structure;

a core member positioned between said primary structural member and said outer skin member;

an antenna structure mounted between said outer skin member and said core member;

an intermediate skin member positioned between said antenna structure and said core member;

a thermally conductive baseplate member positioned on the side of the primary structural member which is away from said core member; and a layer of acoustic damping adhesive operatively positioned between said primary structural member and said thermally conductive baseplate member.

20. A structurally-embedded electronics assembly for integration with the load-carrying structure of a vehicle, said structurally-embedded electronics assembly comprising:

an outer skin member;

a primary load-carrying member positioned inboard from said outer skin member, said primary load-carrying member being structured for attachment to the load-carrying structure;

a core member positioned between said primary load-carrying member and said outer skin member;

at least said core member including a predetermined pattern of material having predetermined electromagnetic properties to form a horn antenna to confine and direct electromagnetic energy toward said outer skin member, an antenna feed connected to said horn antenna to introduce said electromagnetic energy into said horn antenna;

a thermally conductive baseplate member positioned on the side of the primary load-carrying member which is away from said core member; and a layer of acoustic damping adhesive operatively positioned between said primary load-carrying member and said thermally conductive baseplate member.

21. A structurally-embedded electronics assembly for integration with the load-carrying structure of a vehicle, said structurally-embedded electronics assembly comprising:

an outer skin member;

a primary load-carrying member positioned inboard from said outer skin member, said primary load-carrying member being structured for attachment to the load-carrying structure;

a core member positioned between said primary load-carrying member and said outer skin member;

a thermally conductive baseplate member positioned on the side of the primary load-carrying member which is away from said core member;

a layer of acoustic damping adhesive operatively positioned between said primary load-carrying member and said thermally conductive base plate member; and an electronic structure positioned between said outer skin member and said core member.

22. A structurally-embedded electronics assembly for integration with the load-carrying structure of a vehicle, said structurally-embedded electronics assembly comprising:

an outer skin member;

a primary load-carrying member positioned inboard from said outer skin member, said primary load-carrying member being structured for attachment to the load-carrying structure;

a core member positioned between said primary load-carrying member and said outer skin member;

an intermediate skin member positioned between said outer skin member and said core member;

an electronics structure positioned between said intermediate skin member and said core member;

a thermally conductive baseplate member positioned on the side of the primary load-carrying member which is away from said core member; and a layer of acoustic damping adhesive operatively positioned between said primary load-carrying member and said thermally conductive baseplate member.

23. A structurally-embedded electronics assembly for integration with the load-carrying structure of a vehicle, said structurally-embedded electronics assembly comprising:

an outer skin member;

a primary load-carrying member positioned inboard from said outer skin member, said primary load-carrying member being structured for attachment to the load-carrying structure;

a core member positioned between said primary load-carrying member an said outer skin member;

an electronics structure positioned within and enclosed by said core member;

a thermally conductive baseplate member positioned on the side of the primary load-carrying member which is away from said core member; and a layer of acoustic damping adhesive operatively positioned between said primary load-carrying member and said thermally conductive baseplate member.

* * * * *

UNITED STATES PATENT AND TRADEMARK OFFICE

CERTIFICATE OF CORRECTION

PATENT NO. : 5,184,141

DATED : February 2, 1993

INVENTOR(S) : Jerome J. Connolly, ET AL

It is certified that error appears in the above-identified patent and that said Letters Patent is hereby corrected as shown below:

Column 2, line 6, change "antenna o" to --antenna--.

Column 6, line 26, change "Would" to --would--.

Column 8, line 21, change "claim 4" to --claim 11--;

line 44, change "conformed" to --conformal--;

line 46, change "The" to --A--.

Column 10, line 33, change "an" to --and--.

Signed and Sealed this

Eleventh Day of January, 1994

Bruce Lehman

*Attest:*

BRUCE LEHMAN

*Attesting Officer*

*Commissioner of Patents and Trademarks*